US007308993B2

(12) United States Patent
Mineau

(10) Patent No.: US 7,308,993 B2
(45) Date of Patent: Dec. 18, 2007

(54) ACTUATOR CAP AND PRODUCT REFILL FOR A HOUSING

(75) Inventor: Steven B. Mineau, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 461 days.

(21) Appl. No.: 11/006,930

(22) Filed: Dec. 8, 2004

(65) Prior Publication Data

US 2006/0118578 A1 Jun. 8, 2006

(51) Int. Cl.
*B67D 5/06* (2006.01)

(52) U.S. Cl. ..... 222/182; 222/183; 222/325; 222/402.1; 222/402.13; 222/402.23; 222/402.24

(58) Field of Classification Search ..... 222/182–183, 222/321.8, 505, 402.1, 507, 402.13, 402.15, 222/402.21, 402.22, 402.23, 402.25, 325, 222/327, 162, 402.24
See application file for complete search history.

(56) References Cited

U.S. PATENT DOCUMENTS

| | | | | |
|---|---|---|---|---|
| 2,575,124 A | | 11/1951 | Pollitt | 222/162 |
| 2,673,008 A | | 3/1954 | Ryan | 222/162 |
| 2,766,913 A | | 10/1956 | Wilshusen | 222/394 |
| 2,941,700 A | | 6/1960 | Gable | 222/394 |
| 3,127,065 A | | 3/1964 | Stevenson | 222/164 |
| 3,128,916 A | * | 4/1964 | Picot | 222/183 |
| 3,161,196 A | | 12/1964 | Berkow | 128/225 |
| 3,247,655 A | | 4/1966 | Jacob | 56/255 |
| 3,318,492 A | | 5/1967 | Haas | 222/402.11 |
| 3,404,814 A | | 10/1968 | Wakeman | |
| 3,516,424 A | | 6/1970 | Eagle | 132/148 |
| 3,618,833 A | | 11/1971 | Webster | 222/402.22 |
| 3,648,905 A | | 3/1972 | Kauder | 222/402.21 |
| 3,739,941 A | | 6/1973 | Ostrwosky et al. | |
| 3,759,431 A | | 9/1973 | Vos | 222/402.22 |
| 3,760,988 A | | 9/1973 | Ostrowsky | 222/153 |

(Continued)

FOREIGN PATENT DOCUMENTS

| | | |
|---|---|---|
| EP | 0641727 A2 | 8/1994 |
| WO | WO 01/26995 A1 | 4/2001 |
| WO | WO03/024836 | 3/2003 |

OTHER PUBLICATIONS

U.S. Appl. No. 11/007,070, Office Action dated Jun. 1, 2007.
U.S. Appl. No. 10/941,791, Office Action dated Apr. 6, 2007.

*Primary Examiner*—Frederick C. Nicolas

(57) ABSTRACT

A product refill for a housing includes an actuator cap and a container of product. The actuator cap includes a base portion having a mounting end, a central actuator member having a substantially axially oriented discharge orifice, and an axially movable actuator cap portion flexibly connected to the base portion. First and second unshielded outer contact surfaces of the movable portion are separated by an arcuate distance of at least about 90 degrees wherein pressure applied to both of the surfaces axially displaces the surfaces and thus the movable portion toward the mounting end in a generally non-tilting manner thereby displacing the actuator member to an actuating position thereof. A length between at least one of the outer contact surfaces and a centerline of the cap is greater than about one-quarter a largest lateral dimension across the product refill.

24 Claims, 5 Drawing Sheets

U.S. PATENT DOCUMENTS

| | | | | |
|---|---|---|---|---|
| 3,871,557 | A | 3/1975 | Smrt | 222/162 |
| 3,884,398 | A | 5/1975 | McLaughlin | 222/402.13 |
| 3,884,399 | A | 5/1975 | Matern | 222/402.13 |
| 3,888,392 | A | 6/1975 | Van Coney | |
| 3,907,175 | A | 9/1975 | Haas | 222/402.13 |
| 3,915,353 | A | 10/1975 | Haas | 222/402.1 |
| 3,946,911 | A | 3/1976 | Morane et al. | |
| 3,987,942 | A | 10/1976 | Morane et al. | 222/402.15 |
| 4,013,231 | A | 3/1977 | Van Veldhoven | 239/579 |
| 4,077,548 | A | 3/1978 | Beard | 222/321 |
| 4,077,549 | A | 3/1978 | Beard | 222/321 |
| 4,087,027 | A | 5/1978 | Haas | 222/402.13 |
| 4,124,148 | A | 11/1978 | Vieler et al. | 222/321 |
| 4,132,359 | A | 1/1979 | Nozawa | 239/333 |
| 4,138,039 | A | 2/1979 | Micallef | 222/321 |
| 4,186,855 | A | 2/1980 | Edman et al. | 222/321 |
| 4,277,004 | A | 7/1981 | Barlics | 222/402 |
| 4,826,054 | A | 5/1989 | Frutin | 222/402.11 |
| 4,860,932 | A | 8/1989 | Nagy | 222/402.1 |
| 5,139,180 | A | 8/1992 | Lucas | 222/402.13 |
| 5,279,444 | A | 1/1994 | Williams | 222/1 |
| 5,287,998 | A | 2/1994 | Smrt | 222/402.1 |
| D347,263 | S | 5/1994 | Phillips | D23/231 |
| 5,307,959 | A | 5/1994 | Bedore et al. | 222/174 |
| 5,310,096 | A | 5/1994 | Rogers et al. | 222/402.13 |
| 5,335,832 | A | 8/1994 | De Laforcade | 222/402.13 |
| 5,358,147 | A | 10/1994 | Adams et al. | 222/183 |
| 5,411,184 | A | 5/1995 | Smrt | 222/402.13 |
| 5,518,148 | A | 5/1996 | Smrt | 222/174 |
| 5,702,036 | A | 12/1997 | Ferrara, Jr. | 222/402.13 |
| 5,743,431 | A | 4/1998 | Brattesani | 222/1 |
| 5,875,926 | A | 3/1999 | Schwartz | 222/79 |
| 5,875,934 | A * | 3/1999 | Miller et al. | 222/183 |
| 5,915,599 | A | 6/1999 | Takahashi | 222/402.13 |
| 5,971,226 | A | 10/1999 | Goncalves | 222/321.6 |
| 5,992,707 | A | 11/1999 | Gaichuk | 222/402.13 |
| 6,003,739 | A | 12/1999 | Bartlett et al. | 222/402.1 |
| 6,004,056 | A | 12/1999 | De Laforcade | 401/190 |
| 6,299,032 | B1 | 10/2001 | Hamilton | 222/402.15 |
| 6,321,742 | B1 | 11/2001 | Schmidt et al. | 126/38 |
| 6,340,103 | B1 | 1/2002 | Scheindel et al. | 222/402.15 |
| 6,386,397 | B2 | 5/2002 | Brotspies et al. | 222/321.6 |
| 6,390,336 | B1 | 5/2002 | Orozco | 222/162 |
| 6,543,653 | B2 | 4/2003 | Lamboux | 222/321.8 |
| 6,551,001 | B2 | 4/2003 | Aberegg et al. | 401/190 |
| D474,403 | S | 5/2003 | Fahy et al. | D9/448 |
| 6,569,387 | B1 * | 5/2003 | Furner et al. | 422/123 |
| 6,588,631 | B2 | 7/2003 | Sanchez | 222/402.13 |
| 6,592,011 | B1 * | 7/2003 | Lammel et al. | 222/402.11 |
| 2004/0028458 | A1 | 2/2004 | Heathcock et al. | 401/190 |
| 2004/0188473 | A1 | 9/2004 | Groh et al. | 222/402.13 |
| 2004/0222245 | A1 | 11/2004 | Marroncles | 222/402.13 |

* cited by examiner

ACTUATOR CAP AND PRODUCT REFILL FOR A HOUSING

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to actuating apparatus, and more particularly to actuator caps that are placed on containers and used to dispense product from the containers.

2. Description of the Background of the Invention

Various apparatus for dispensing product from a container or reservoir of product have been developed. Smrt U.S. Pat. No. 5,287,998 discloses an actuator fitted to a container and including an axially extending passage therethrough for discharging product. The actuator includes a pair of wings that extend transversely from the actuator. The container may be moved axially within a device such that the wings bear against a surface defining a passage, thereby discharging product through the passage.

Brotspies et al. U.S. Pat. No. 6,386,397 discloses a spray bottle grip used with a nasal spray bottle. The grip is coupled to a reciprocating nozzle of the spray bottle, and two arms extend downwardly along the spray bottle. The arms include finger flanges that provide an ergonomic means of reciprocating the nozzle to dispense product from the spray bottle.

Haas U.S. Pat. No. 3,318,492 discloses a disc-shaped actuator attached to a nozzle of a container. A user may depress the actuator with his finger to dispense product from the container.

Scheindel et al. U.S. Pat. No. 6,340,103 discloses a handle extending along a container body. When a user pulls the handle toward the container body, a portion of the handle pushes downwardly upon a nozzle portion of the container to dispense product from the container.

Micallef U.S. Pat. No. 4,138,039 discloses a container having a vertically reciprocating tubular pump. A cap is fitted to the container and includes an actuator button extending from a sidewall of the cap. Movement of the actuator button in a direction toward the sidewall of the cap is translated into perpendicular reciprocating movement of the pump.

Other patents disclose devices having a container of product disposed at a first end of a rod and having a trigger mechanism at a second end of the rod wherein a user may actuate the container from a distance. Discharging product from a distance can be an advantage for many purposes, such as accessing hard-to-reach places or perhaps for discharging an insecticide into a hornet nest without placing oneself too close to the nest. Smrt U.S. Pat. No. 5,518,148 discloses a device where an actuating rod has a trigger on a first end and a container on a second end. Pulling the trigger moves the actuating rod longitudinally such that the second end of the rod moves a bell crank, which in turn, moves an additional rod that actuates a valve on the container. Aberegg et al. U.S. Pat. No. 6,551,001, assigned to the assignee of the present application and the disclosure of which is incorporated by reference herein, discloses a cleaning device having a trigger at a first end of a rod and a mop cleaning head and a container at a second end of the rod. Pulling the trigger moves a pivot link, which in turn actuates a valve of the container, thereby discharging product from the container onto the surface to be cleaned by the mop cleaning head.

Adams et al. U.S. Pat. No. 5,358,147, assigned to the present assignee and also incorporated herein by reference, discloses a container of air freshener inserted into a shroud. The shroud includes a nozzle that is fitted over a valve stem of the container. The combination of the container and the shroud is placed within a housing. When a user wishes to spray air freshener into ambient air, the user pushes the housing, which in turn pushes the shroud and the valve stem to dispense the air freshener out of the housing.

SUMMARY OF THE INVENTION

In accordance with one aspect of the present invention, a product refill for a housing includes an actuator cap and a container of product. The actuator cap includes a base portion having a mounting end, a central actuator member having a substantially axially oriented discharge orifice, and an axially movable actuator cap portion flexibly connected to the base portion. First and second unshielded outer contact surfaces of the movable portion are separated by an arcuate distance of at least about 90 degrees. Pressure applied to both of the surfaces axially displaces the surfaces and thus the movable portion toward the mounting end in a generally non-tilting manner thereby displacing the actuator member to an actuating position thereof. A length between at least one of the outer contact surfaces and a centerline of the cap is greater than about one-quarter a largest lateral dimension across the product refill.

In accordance with a further aspect of the present invention, an actuator cap for a container of product includes a circumferential base portion having a mounting end and a circumferential movable actuator cap portion. Exterior contact surfaces of the movable portion are separated by an arcuate distance of at least about 90 degrees. A spring member connects the portions. The movable portion is deflectable relative to the base portion. Pressure applied to the surfaces axially displaces the surfaces and thus the movable portion toward the mounting end. A central actuator member includes a substantially axially oriented discharge orifice. Deflection of the movable portion displaces the actuator member to an actuating position thereof. A dimension between at least one of the contact surfaces and an axial centerline of the cap is greater than about one-quarter a largest diameter of the cap.

In accordance with a further aspect of the present invention, a product refill for a housing includes an actuator cap and a container of product. The actuator cap includes a base portion having a mounting end, a central actuator member having a discharge orifice oriented at an angle to an axial centerline of the cap wherein the angle is less than 90 degrees, and an axially movable actuator cap portion flexibly connected to the base portion. An unshielded outer contact surface of the movable portion is provided. Displacement of the contact surface, and thus the movable portion, displaces the actuator member to an actuating position thereof. A length between the outer contact surface and the axial centerline of the cap is greater than about one-quarter a largest lateral dimension of the product refill.

Other aspects and advantages of the present invention will become apparent upon consideration of the following detailed description.

DETAILED DESCRIPTION OF THE PREFERRED EMBODIMENTS

Figure 1:
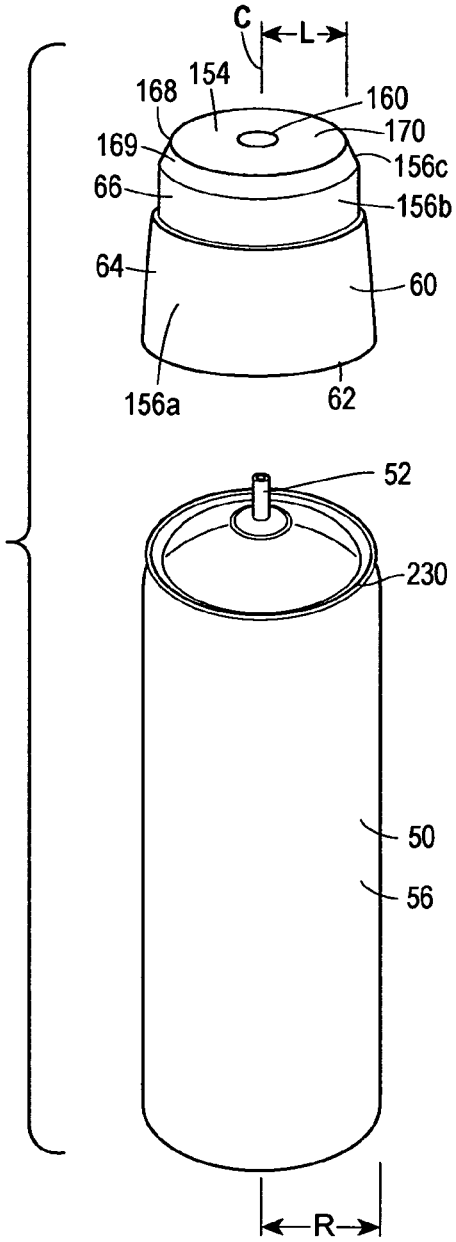
FIG. 1 is an exploded isometric view of a container and actuator cap.
Figure 2:
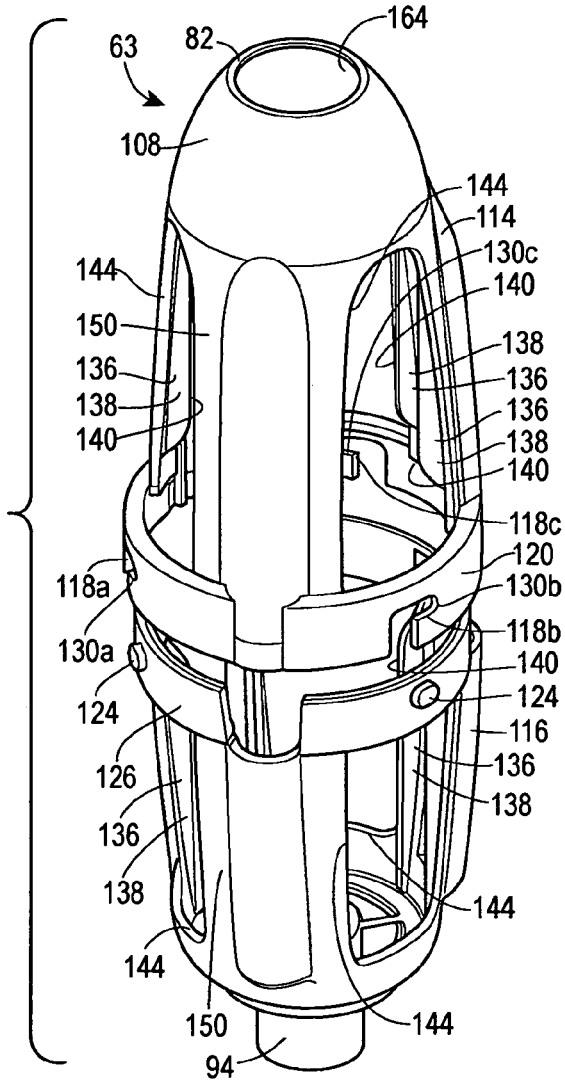
FIG. 2 is an exploded isometric view of a housing into which the container and actuator cap of FIG. 1 may be placed.
Figure 3:
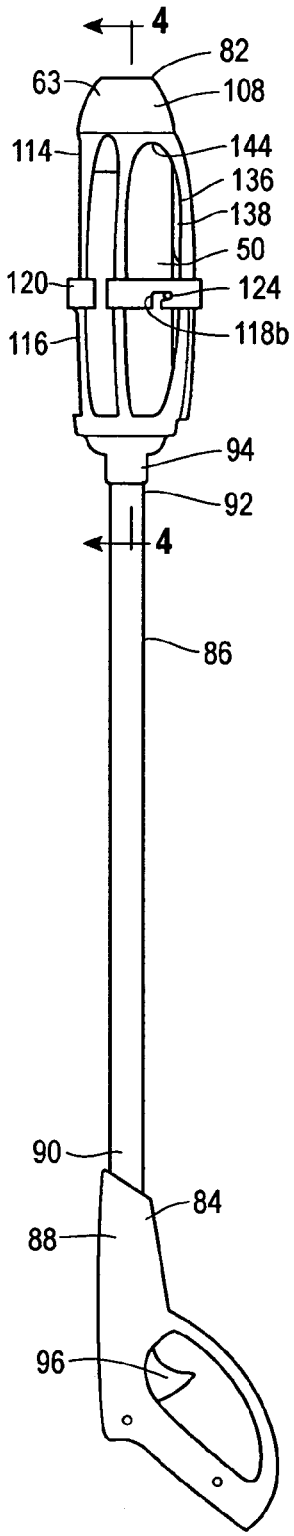
FIG. 3 is a side elevational view showing a rod and trigger mechanism in combination with the housing of FIG. 2.
Figure 4:
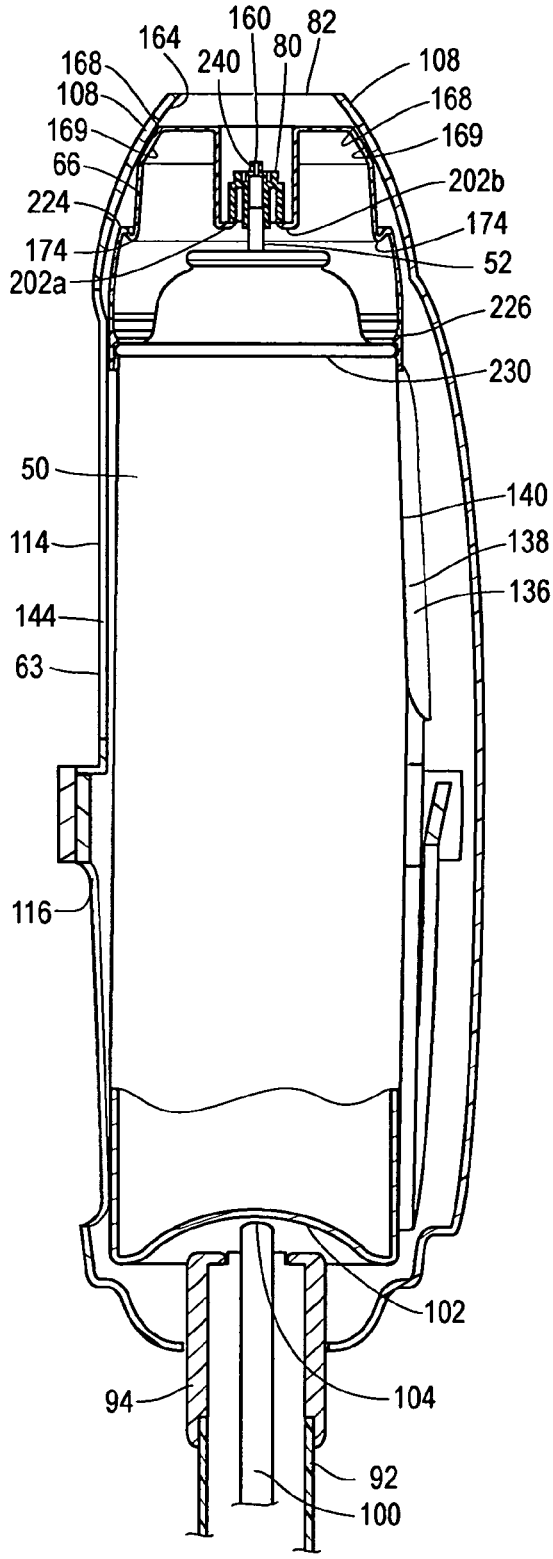
FIG. 4 is a sectional view taken generally along the lines 4-4 of FIG. 3 further illustrating the container and the actuator cap of FIG. 1 in elevation and in section, respectively.

Referring to FIG. 1, a container 50 has a valve stem 52 and a main body 56 containing product. The valve stem 52 could be either a vertically depressible valve stem or a tilt valve stem. As will be appreciated hereinafter, if a tilt valve stem is utilized such stem could also alternatively be depressed vertically without tilting to dispense product therethrough. It should be noted that the valve stem 52 could be replaced by any suitable valve apparatus that may be displaced to release product from the container 50. An actuator cap 60 is fitted to the container 50 at a mounting end 62 thereof. FIG. 2 illustrates a housing 63 into which the container 50 and the actuator cap 60 may be placed. The container 50 and the actuator cap 60 are a product refill for the housing 63. It should be noted that the product refill may include additional components (not shown) besides the container 50 and the actuator cap 60, such as a sleeve (not shown) disposed around the container 50. The actuator cap 60 has a base portion 64 and a movable portion 66 that is axially deflectable toward the mounting end 62. Referring to FIG. 4, the actuator cap 60 includes any suitable central adapter 80 secured to the valve stem 52. The housing 63 has a discharge opening 82 through which product stored within the container 50 may be dispensed. Referring to FIGS. 3 and 4, relatively moving the container 50 and the housing 63 such that the container 50 is moved toward the discharge opening 82 deflects the movable portion 66, thereby actuating the valve stem 52 as described hereinbelow, causing product to be released from the container 50 and dispensed from the housing 63. A rod and trigger mechanism 84 may be used to move the container 50 within the housing 63. The mechanism 84 includes a hollow tube 86 with a handle assembly 88 at a first end 90 of the tube 86, and a second end 92 of the tube 86 may be secured within a sleeve 94 of the housing 63 in any suitable manner such as by welding or appropriately threading the sleeve 94 and the end 92. Pulling a trigger 96 of the handle assembly 88 advances a push rod 100 disposed within the tube 86 against a bottom surface 102 of the container 50, thereby advancing the container 50 toward the discharge opening 82. If necessary or desirable, an end 104 of the push rod 100 may be shaped and/or fitted with a plate (not shown) or other member to distribute forces more evenly across the bottom surface 102 of the container 50. Further, if desired, rather than moving the container 50 relative to the housing 63 by using the rod and trigger mechanism 84 one could move the container 50 and/or the housing 63 relative to one another by hand to dispense product.

The housing 63 includes a wall 108 that decreases in cross sectional size, tapering to the discharge opening 82. The discharge opening 82 has a cross sectional size greater than a radius R (FIG. 1) of the container 50. Referring again to FIG. 2, the housing 63 may include first and second wall portions 114, 116 that may be joined together to house the container 50 and the actuator cap 60. The wall portion 114 may include three bayonet slots 118*a*-118*c* disposed on an end 120 of the portion 114 and equally spaced from one another by 120 degrees. To join the portions 114, 116, a user inserts pins 124 carried by an end 126 of the portion 116 into the slots 118*a*-118*c* and provides a relative rotation of the portions 114, 116 to seat the pins 124 within recessed regions 130*a*-130*c* of the slots 118.

Figure 5:
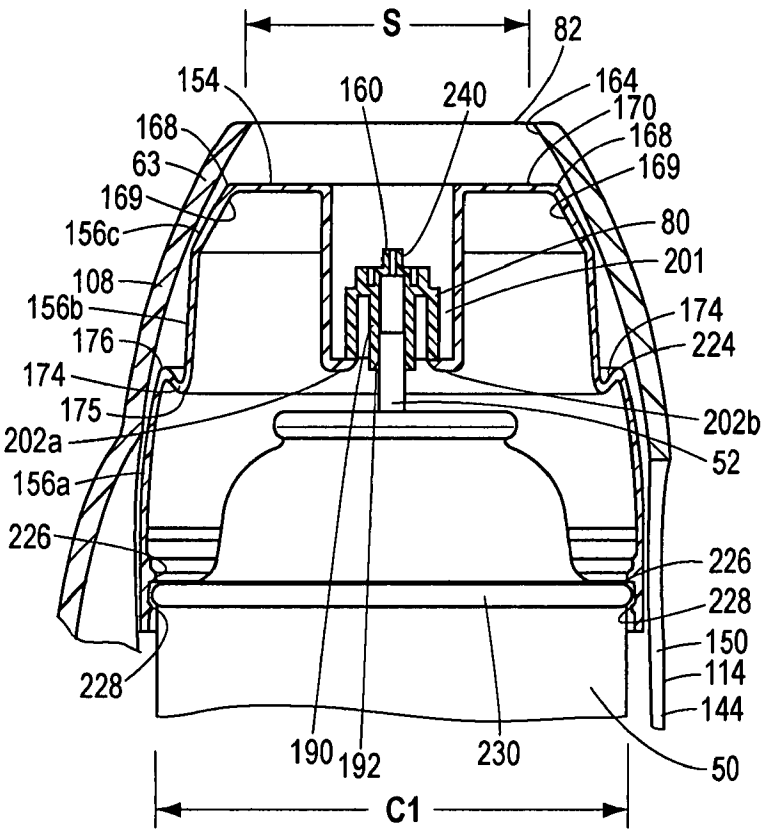
FIG. 5 is an enlarged fragmentary view of FIG. 4.

Either of the portions 114, 116 may include protrusions 136 such as guide fins 138 having edges 140 that abut the exterior surface of the container 50 to center the container 50 within the housing 63. Either of the portions 114, 116 may include elongate openings or windows 144 that allow a user to see the container 50 when the container 50 is disposed within the housing 63. The housing 63 may include three of the windows 144 spaced apart by 120 degrees. One advantage of the windows 144 is that a user might see any written directions or graphics disposed on the container 50. Referring to FIG. 5, a main region 150 of the wall portions 114 and 116 may have an inner cross sectional size C1 of about 66 mm, and thus the product refill, comprising the container 50 and the actuator cap 60, could have a cross sectional size of up to about 66 mm. In this regard, while a range of sizes is available for the container 50 one might wish to provide a container sized near maximum (i.e., C1) to provide a maximum useful life for the container 50 given the available space within the housing 63.

Figure 6:
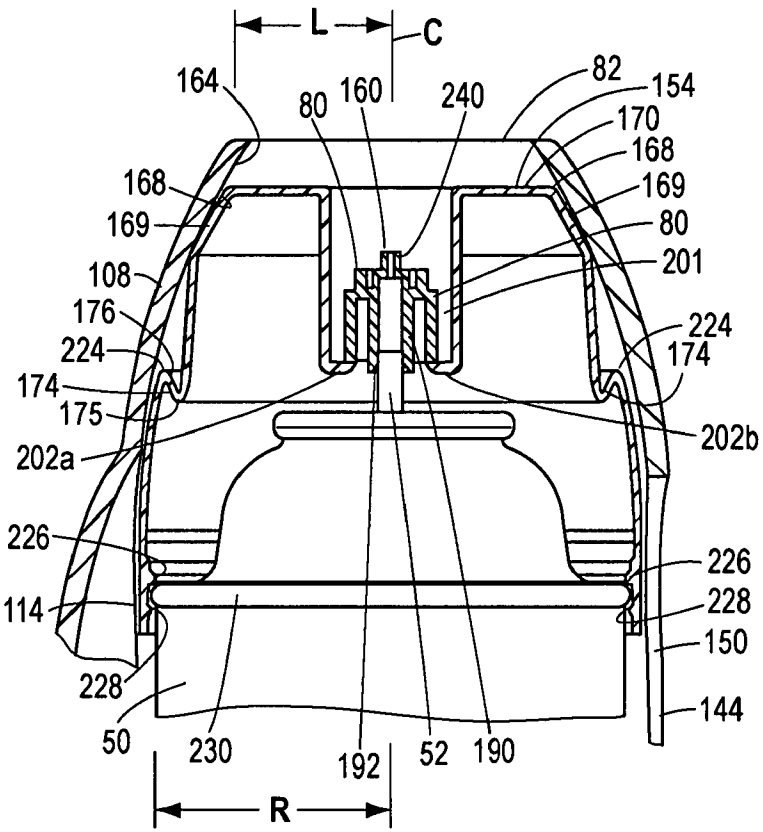
FIG. 6 is a view similar to FIG. 5, but showing an actuating position.
Figure 7:
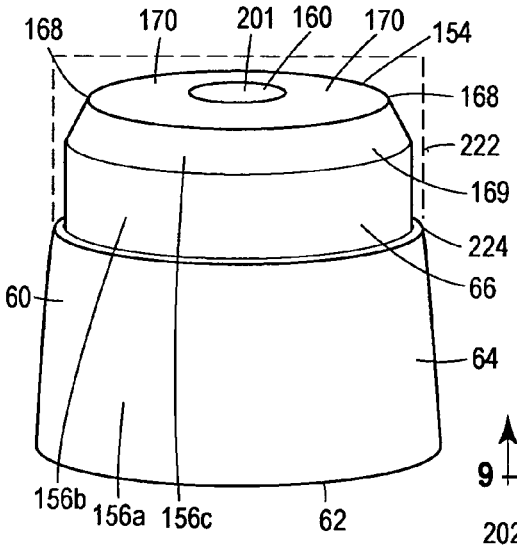
FIG. 7 is an isometric view of the actuator cap of FIG. 1.

Referring to FIG. 7, the actuator cap 60 decreases in cross sectional size along an axial dimension defined between the mounting end 62 for mounting to the container 50 and a second end 154 opposite thereto. The actuator cap 60 provides a useful centering function in that one or more peripheral surfaces 156*a*-156*c* of the cap 60 maintain a point of discharge 160 of the actuator cap 60 in a centrally located position relative to the discharge opening 82, thereby minimizing the potential for product impingement against a surface 164 of the tapered wall 108. The surfaces 156*a*-156*c* may be tapered. Referring to FIG. 6, a length L is defined between a longitudinal centerline C of the cap 60 and outer contact surfaces 168 of the movable portion 66. The length L is selected relative to the inner dimensions of the tapered wall 108 such that the contact surfaces 168 are disposed in interfering relationship with the tapered wall 108. It should be appreciated that the actuator cap 60 and/or the movable portion 66 could have any suitable shape so long as the movable portion 66 is sized to have an interference relationship with the tapered wall 108. The length L may have any suitable value such as greater than about one-quarter (25%) a largest diameter of the product refill or greater than or equal to one-third (33%) the largest diameter of the product refill, whether the largest diameter is defined by the container 50, the actuator cap 60, or some other structure of the product refill. The length L may be greater than about one-quarter (25%) of a largest diameter D of the cap 60, measured at the mounting end 62. L could measure greater than or equal to about one-third the largest diameter D. Of course, the length L may be alternatively expressed relative to the size of the container 50. The contact surfaces 168 may be part of a tapered wall 169 generally complementary with the shape of the tapered wall 108. Alternatively, the contact surfaces 168 may be formed by a radial wall 170.

For the housing 63, one could select any suitable cross sectional size S (FIG. 5) for the discharge opening 82, such as a cross sectional size of about 34 mm, and suitable values of L might range between about 18 mm and about 33 mm to provide the above-described interfering relationship. A preferred value for L may be about 25 mm. It should be noted that while the tapered wall 108 of the housing 63 is illustrated as symmetrical around the longitudinal centerline C of the housing 63, the wall 108 could be made asymmetrical, greater in cross sectional size in one plane rather than another, and the shape of the actuator cap 60 could be made complementary therewith to serve as a keying function to orient the container 50 relative to the housing 70 in a particular angular orientation. This could be advantageous for various reasons, such as where product discharges in an asymmetrical pattern.

Figure 9:
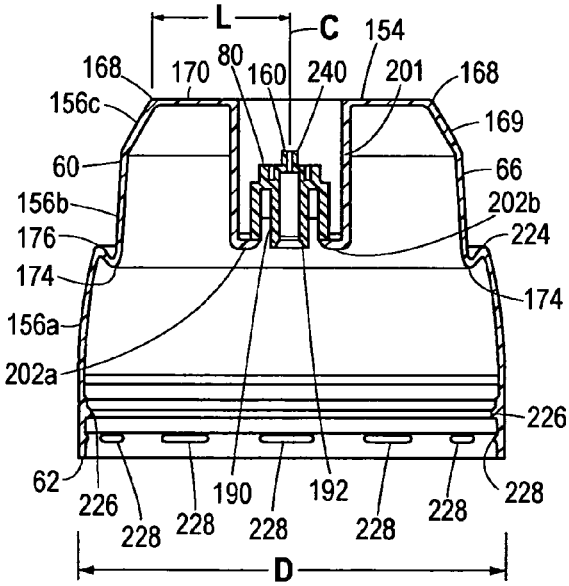
FIG. 9 is a sectional view taken generally along the lines 9-9 of FIG. 8.
Figure 10:
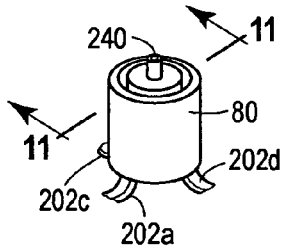
FIG. 10 is an enlarged fragmentary isometric view of a component of the actuator cap of FIG. 1.

Referring to FIGS. 5, 6, and 9, the movable portion 66 is flexibly connected to the base portion 64 in any suitable manner that allows the movable portion 66 to move axially relative to the base portion. For example, a circumferential flexure member 174, such as a bight 175, could connect the portions 64, 66. The flexure member 174 could be formed of a different material than the portions 64, 66, or the same material. The flexure member 174 could simply be a living hinge where the flexure member 174 is essentially a wall that is thinner than the portions 64 and 66 and thus flexible. Relatively moving the container 50 and the discharge opening 82 toward one another as described above, causes the surfaces 168 to engage the tapered housing wall 108 as shown in FIG. 5. Referring to FIG. 6, further force acting on the container 50 in a direction toward the discharge opening 82 causes the movable portion 66 of the cap 60 to axially displace toward the container 50 about the flexure member 174. The flexure member 174 may be provided with a resilient bias. In this regard, the flexure member 174 may elastically stretch or may alternatively bend or roll a portion 176 of the wall of the base portion 64 to the position shown in FIG. 6 to accommodate movement of the movable portion 66 relative to the base portion 64. Movement of the movable portion 66 displaces the valve stem 52 into the container 50 such that product is dispensed out of the housing 63. Dispensing occurs when sufficient force acts on the container 50 to sufficiently move the movable portion 66 and thus the central adapter 80 to the actuating position thereof. For dispensing to occur the force must be sufficient to overcome the resistance to movement of the valve stem 52 and any resistance to movement of the flexure member 174.

Figure 8:
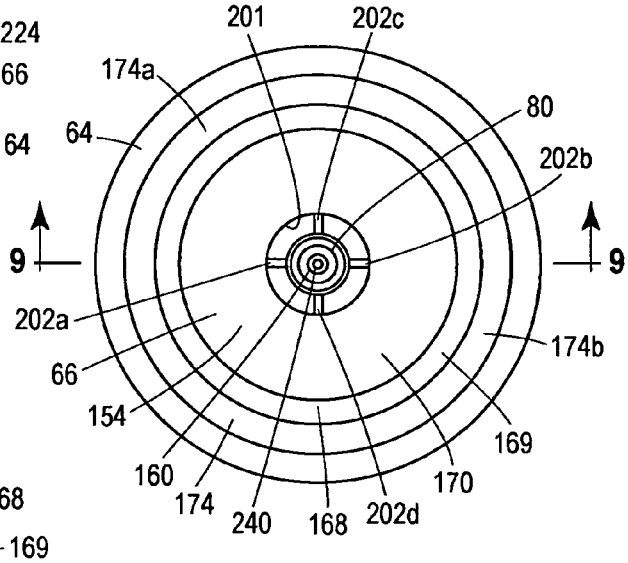
FIG. 8 is a plan view of the actuator cap of FIG. 1.
Figure 11:
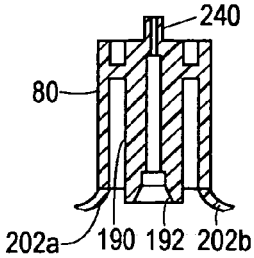
FIG. 11 is an enlarged sectional view taken generally along the lines 11-11 of FIG. 10.
Figure 12:
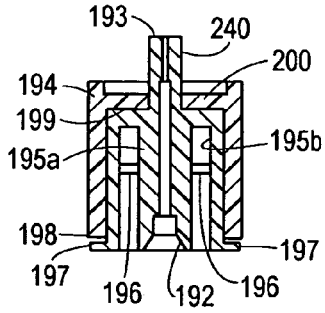
FIG. 12 is an enlarged sectional view of an alternative component to that shown in FIG. 10.

The central adapter 80, secured to the valve stem 52, includes a nozzle member 190 having a tapered surface 192 to facilitate insertion of the valve stem 52 therein. While FIG. 11 shows the adapter 80 having the integrally molded nozzle member 190, FIG. 12 shows that a separately molded nozzle and adapter 193, 194, respectively, are possible. The nozzle 193 is snap fitted into the adapter 194. The nozzle 193 includes inner and outer circumferential walls 195*a*, 195*b*, which may be connected by one or more posts 196. The nozzle 193 includes a circumferential flange 197 abutting a circumferential surface 198 of the adapter 194, and a shoulder surface 199 of the nozzle 193 abuts a wall 200 of the adapter 194. Referring to FIG. 9, the movable portion 66 includes a circumferential wall 261 housing the central adapter 80. Referring also to FIG. 8, first through fourth rigid straps 202*a*-202*d* connect the circumferential wall 201 to the central adapter 80, such that the central adapter 80 is movable with the movable portion 66. Of course, other designs (not shown) within the scope of the present invention(s) should be apparent to those of ordinary skill in the art where the central adapter 80 is not connected to the movable portion 66, but is instead connected to the base portion 64. According to such an alternative design, the central adapter 80 would be flexibly connected in any suitable manner to the base portion 64, and movement of the movable portion 66 would cause a surface of the movable portion 66 to contact and displace the central adapter 80. Alternatively, the central adapter 80 even could be a separate piece from the actuator cap 60, connected only to the valve stem 52. According to such a design, a suitable projection or other actuating surface (not shown) of the movable portion 66 would come into contact with the central adapter 80 to displace same.

Referring to FIG. 7, any suitable cover (not shown) could be fitted to the actuator cap 60 at the position of a phantom line 222 to shield the movable portion 66, thereby preventing inadvertent dispensing of product during shipment. The cap 60 includes a ledge 224 that may be modified as necessary to have a cover secured thereto. Referring to FIG. 9, the actuator cap 60 may include a circumferential inwardly-tapered flange 226 and a plurality of spaced apart inwardly-directed beads 228. As shown in FIGS. 5 and 6, the flange 226 and the beads 228 are snap fitted over a rim 230 of the container 50.

Sufficient displacement of the central adapter 80 to an actuating position thereof displaces the valve stem 52 into the container 50 such that product dispenses from the container 50, through a spray tip 240 of the nozzle member 190 and out of the housing 63. Referring also to FIG. 8, it should be noted that the flexure member 174 provides flexibility around the entire circumference thereof, allowing substantially axial reciprocating movement of the movable portion 66 and thus the valve stem 52, rather than tilting movement. If one were to make the flexure member 174 flexible around only half the circumference thereof, then this might result in tilting deflection of the movable portion 66, potentially increasing the likelihood of product discharge against the tapered wall 108. While the flexure member 174 is generally shown and described as circumferential, it is within the scope of the present invention(s) to modify the flexure member 174 to include one or more voids such that the flexure member 174 does not connect the movable portion 66 around an entire circumference thereof, but instead only connects the movable portion 66 to the base portion 64 at flex points 174*a* and 174*b* (FIG. 8). The points 174*a*, 174*b* could be circumferentially spaced as necessary to achieve non-tilting deflection of the movable portion 66 such as by spacing the points 174*a*, 174*b* by 90 degrees, 120 degrees or 180 degrees.

Figure 13:
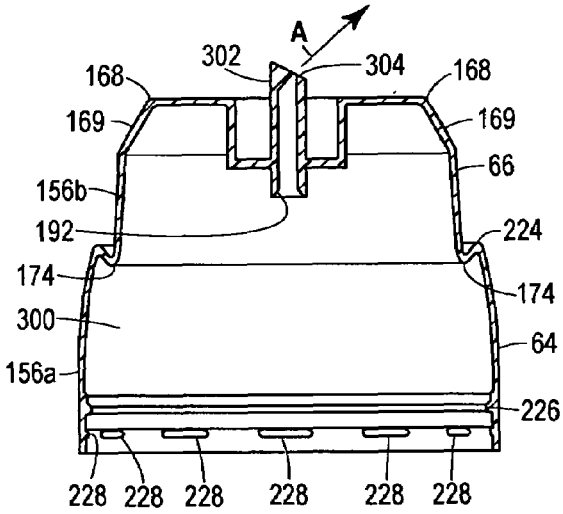
FIG. 13 is a full sectional view of an alternative actuator cap.
Figure 15:
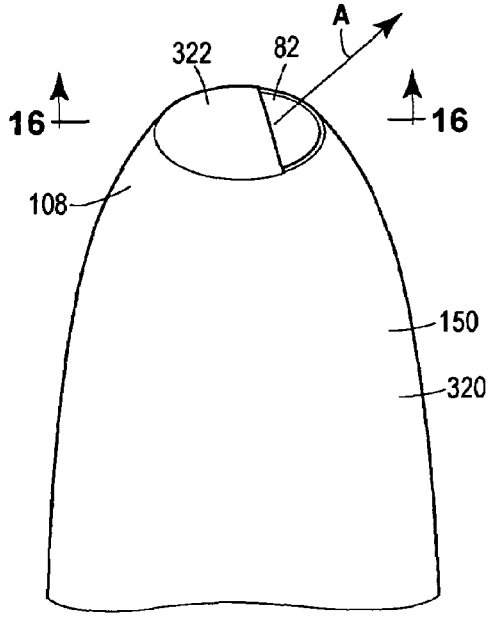
FIG. 15 is a fragmentary isometric view of a housing into which the actuator cap and container of FIGS. 13 and 14 may be placed.
Figure 14:
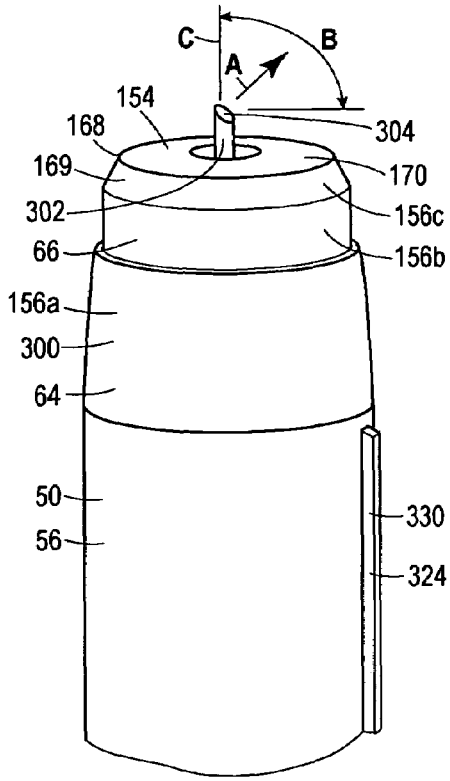
FIG. 14 is a fragmentary isometric view of the actuator cap of FIG. 13 secured to a container of product.
Figure 16:
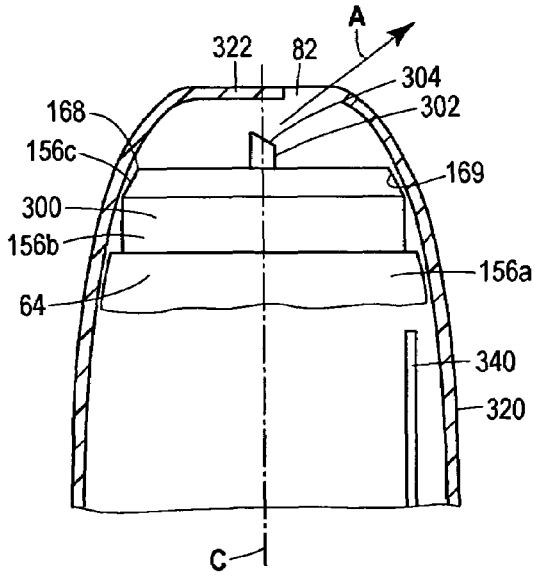
FIG. 16 is a sectional view taken generally along the lines 16-16 of FIG. 15 and including a fragmentary elevational view of the actuator cap of FIG. 13.

FIGS. 13 and 14 illustrate an alternative actuator cap 300 wherein common structures are given like reference numerals. The cap 300 includes an adapter 302 having a spray tip 304 that directs product discharge in the direction of an arrow A. Apart from the adapter 302, the cap 300 may otherwise be similar or identical to the cap 60. An angle of discharge B from the axial centerline C may be of any suitable value less than 90 degrees, such as 15, 20, or 45 degrees. Referring to FIG. 15, a housing 320 may be provided for the cap 300, and the housing 320 includes a wall 322 that covers a portion of the discharge opening 82. If one attempted to use an actuator cap that discharges product axially along the centerline C, rather than at an angle thereto, such product would impinge against the wall 322. In the design of the components of FIGS. 13-16, one may provide any suitable structures for orienting the container 50 and the cap 300 in a particular angular orientation relative to the housing 63. For example, FIG. 14 shows that the container 50 may include a positioning key 324, such as a rib 330 that is radially aligned with the spray tip 304 for orienting the container 50 and the actuator cap 300 within the housing 320. FIG. 16 shows a slot 340 that receives the rib 330 to align the container 50 and the cap 300 such that the spray tip 304 discharges product out of the housing 320 rather than against the wall 322. It is within the scope of the invention(s) to alternatively provide a suitable key on the actuator cap 300 and a corresponding slot (not shown) therefor in the housing 320. In addition, one might alternatively provide the product refill with a particular shape corresponding to a particular internal shape of the housing 320 such that the product refill may only be disposed inside the housing 320 in a particular angular orientation.

The actuator cap embodiments disclosed herein may be designed to reduce the likelihood of inadvertent dispensing that might result from a user inadvertently shaking or jostling the housing 63 with the container 50 disposed therein. In this regard, the flexure member 174 may be designed with a suitable degree of resilient bias acting against axial movement of the movable portion 66, and a manufacturer may increase or decrease this resistance as desired for a particular actuator cap design.

The resistance of the flexure member 174 against movement provides a reactive force against forces directing the container 50 toward the discharge opening 82, such that this reactive force must be overcome before dispensing may occur. This reactive force is advantageous in that low force levels may be insufficient to overcome same to dispense product from the housing 63. For example, such low force levels may occur from a user jostling the housing 63 while walking or manipulating the housing 63 or may arise as a user shakes the housing 63 to mix the contents of the container 50. Such jostling could cause the cap 60 to be in a condition where the movable portion 66 is moved only slightly but to a lesser extent than the actuating position thereof. Ideally, the reactive force provided by the flexure member prevents inadvertent dispensing until such time as the user intentionally applies sufficient force, such as when the user intentionally pulls the trigger 96 shown in FIG. 3 to intentionally dispense product, while inadvertent dispensing is avoided.

The foregoing embodiments may provide one or more of the following advantages.

First, because the contact surfaces 168 have a sufficiently large value of L, the surfaces 168 have an interfering relationship with the tapered wall 108, and thus, the actuator cap 60 is usable with the housing 63 despite the large discharge opening 82. (As noted above, the cross sectional size of the discharge opening 82 is greater than the container radius R.) Containers lacking contact surfaces of the length L are not usable with the housing 63. This may be useful because containers lacking the contact surfaces 168 of length L may not be designed for use with the housing 63 or the housing 63 may not be marketed for use with a particular container of product that lacks the contact surfaces 168. For example, the housing 63 may be marketed for use with a container of a specific type of insecticide having the actuator cap 60. A further advantage of the large discharge opening 82 and large value of L is that contact near the point of discharge 160 is avoided. Because the tapered wall 108 contacts the contact surfaces 168 at the distance L (or greater) from the orifice of the valve stem 52, the potential for product obstruction or impingement is minimized. This feature could be especially advantageous for some products that fan out while discharging from the container 50 as the product gets farther away from the container 50. The large cross sectional size of the discharge opening 82 would accommodate such fanning out while minimizing potential product impingement or deposition thereupon. In this regard, referring to FIG. 9, the circumferential wall 201 may be constructed with a shorter axial dimension than shown such that the spray tip 240 is positioned closer to the radial surface 170 of the cap 60, and thus is positioned closer to the discharge opening 82 of the housing 63. A further advantage of the large discharge opening 82 is that the surface 164 of the tapered wall 108 might be potentially more easily manually accessed for cleaning than other housing types.

The product stored within the container body 56 could be any of a broad variety of products such as an air freshener, an insect control agent, a hair spray, a cleaning agent, a polishing agent, a fragrance, or other any other product stored in a container. Further, the product may be pressurized by a suitable propellant disposed within the container 50.

Referring to FIG. 9, Table 1 below provides sample dimensions for one example according to the present invention. The following dimensions are not to be construed as limiting and are merely exemplary. (All dimensions are in millimeters unless otherwise specified.)

TABLE 1

| Reference | Dimension |
|---|---|
| D | 65.5 |
| L | 18 |

It should be evident from FIG. 9 that D references the largest diameter of the cap 60, and table 1 shows that L may have a value greater than one-quarter the largest diameter D.

Table 2 provides sample dimensions for a second example according to the present invention.

TABLE 2

| Reference | Dimension |
|---|---|
| D | 65.5 |
| L | 23.2 |

Table 2 shows that L may have a value of about one-third the largest diameter of the cap 60. So, assuming the diameter D is 65.5 mm, about one-third of such diameter may range between about 20 mm and about 25 mm. L may also be greater than one-third of D. It should be noted that other values of D greater or less than 65.5 mm are possible.

The value of D of the cap 60 may be the same, similar, or substantially different than the diameter of the container 50. Referring to FIG. 1, the value of L relative to the diameter of the container 50 may be greater than one-quarter the diameter of the container 50, may be about one-third the diameter of the container 50, or may have other values relative to the diameter of the container 50. In any event, a largest lateral dimenion across the product refill cannot exceed the internal cross sectional size C1 of the housing 63, and L may have any suitable value such as greater than about one-quarter (25%) of this largest lateral dimension.

INDUSTRIAL APPLICABILITY

The foregoing embodiments are useful for dispensing a variety of products such as insecticides, cleaning products, air treatment products (e.g., air fresheners), or other products.

Numerous modifications to the present invention will be apparent to those skilled in the art in view of the foregoing description. Accordingly, this description is to be construed as merely exemplary of the inventive concepts taught herein and is presented for the purpose of enabling those skilled in the art to make and use the invention and to teach the best mode of carrying out same. The exclusive rights to all modifications which come within the scope of the appended claims are reserved.

I claim:

1. A product refill for a housing, comprising:

a container of product; and an actuator cap comprising:

a base portion having a mounting end;

a central actuator member having a substantially axially oriented discharge orifice;

an axially movable actuator cap portion including a circumferential wall flexibly connected to the base portion and surrounding the central actuator member; and first and second unshielded outer contact surfaces of the axially movable actuator cap portion separated by an arcuate distance of at least about 90 degrees;

wherein pressure applied to both of the first and second unshielded outer contact surfaces axially displaces the surfaces and thus the axially movable actuator cap portion toward the mounting end in a generally non-tilting manner thereby displacing the central actuator member to an actuating position thereof and a length between at least one of the outer contact surfaces and a centerline of the actuator cap is greater than about one-quarter a largest lateral dimension of the product refill.

2. The product refill of claim 1, wherein the movable actuator cap portion is connected to the base portion at first and second flexure points separated by an arcuate distance of at least about 90 degrees.

3. The product refill of claim 2, wherein the portions are connected by a circumferential flexure member.

4. The product refill of claim 1, wherein product discharges from the container when the actuator member is displaced to the actuating position thereof.

5. The product refill of claim 4, in combination with a housing having a housing wall that tapers to a discharge opening and wherein the discharge opening has a cross sectional size larger than a radius of the container and wherein the contact surfaces are disposed in interfering relationship with the housing wall.

6. The product refill of claim 4, wherein the length is greater than one-quarter a diameter of the container.

7. The product refill of claim 1, wherein the length is about one-third a diameter of the cap.

8. The product refill of claim 6, wherein the length is about one-third a diameter of the container.

9. The product refill of claim 1, wherein the cap tapers from the mounting end to a second end axially opposite the mounting end.

10. The product refill of claim 1, wherein the central actuator member is integral with the movable cap portion.

11. The product refill of claim 1, in combination with a housing and further comprising means for orienting the product refill in a particular angular orientation when placed into the housing.

12. The product refill of claim 1, further comprising a positioning key.

13. The product refill of claim 12, wherein the positioning key comprises a positioning rib extending from the product refill.

14. The product refill of claim 1, wherein the contact surfaces are tapered.

15. An actuator cap for a container of product, comprising:

a circumferential base portion having a mounting end;

a circumferential axially movable actuator cap portion including a circumferential wall surrounding a central actuator member;

exterior contact surfaces of the axially movable actuator cap portion separated by an arcuate distance of at least about 90 degrees;

a spring member connecting the circumferential base portion and the circumferential axially movable actuator cap portion wherein the movable portion is deflectable relative to the base portion and wherein pressure applied to the exterior contact surfaces axially displaces the surfaces and thus the movable portion toward the mounting end; and the central actuator member having a substantially axially oriented discharge orifice;

wherein deflection of the axially movable actuator cap portion displaces the central actuator member to an actuating position thereof and a dimension between at least one of the exterior contact surfaces and an axial centerline of the actuator cap is greater than about one-quarter a largest diameter of the cap.

16. The actuator cap of claim 15, wherein the surfaces are separated by an arcuate distance of about 180 degrees.

17. The actuator cap of claim 15, in combination with a container of product.

18. The actuator cap of claim 15, wherein the dimension is at least about one-third the largest diameter.

19. A product refill for a housing, comprising:

a container of product; and an actuator cap comprising:

a base portion having a mounting end;

a central actuator member having a discharge orifice oriented at an angle to an axial centerline of the cap wherein the angle is less than 90 degrees;

an axially movable actuator cap portion including a circumferential wall flexibly connected to the base portion and surrounding the central actuator member; and an unshielded outer contact surface of the axially movable actuator cap portion;

wherein displacement of the unshielded outer contact surface and thus the axially movable actuator cap portion displaces the central actuator member to an actuating position thereof and a length between the outer contact surface and the axial centerline of the actuator cap is greater than about one-quarter a largest lateral dimension of the product refill.

20. The product refill of claim 19, wherein the largest lateral dimension of the product refill is a largest diameter of the product refill.

21. The product refill of claim 19, wherein the cap includes first and second outer contact surfaces separated by an arcuate distance of at least about 90 degrees wherein pressure applied to the surfaces axially displaces the surfaces and thus the movable portion toward the mounting end in a generally non-tilting manner.

22. The product refill of claim 19, in combination with a housing and further comprising means for orienting the product refill in a particular angular orientation when placed into the housing.

23. The product refill of claim 19, further comprising a positioning key radially aligned with the discharge orifice.

24. The product refill of claim 23, wherein the positioning key comprises a positioning rib extending from the product refill.

* * * * *